US008627845B2

(12) United States Patent
Hanson et al.

(10) Patent No.: US 8,627,845 B2
(45) Date of Patent: Jan. 14, 2014

(54) DIRECTIONAL CONDUIT GUIDE SUPPORT

(75) Inventors: Matthew N. Hanson, Wayzata, MN (US); Philip F. Fandrei, Bloomington, MN (US)

(73) Assignee: Auto-Mark, Inc., Eden Prairie, MN (US)

( * ) Notice: Subject to any disclaimer, the term of this patent is extended or adjusted under 35 U.S.C. 154(b) by 829 days.

(21) Appl. No.: 12/660,433

(22) Filed: Feb. 26, 2010

(65) Prior Publication Data

US 2011/0210183 A1 Sep. 1, 2011

(51) Int. Cl.
*B08B 9/00* (2006.01)

(52) U.S. Cl.
USPC ..... 137/379; 137/377; 137/381; 134/102.1; 134/102.2; 134/169 A; 138/110; 138/121

(58) Field of Classification Search
USPC ..... 137/3, 377, 379, 381, 599.12, 806, 896; 222/74; 134/102.1, 102.2, 172, 169 A; 138/DIG. 8, 110, 106, 121
See application file for complete search history.

(56) References Cited

U.S. PATENT DOCUMENTS

| | | | | | |
|---|---|---|---|---|---|
| 124,897 | A | * | 3/1872 | Honsinger | 138/110 |
| 2,366,073 | A | | 12/1944 | Vallerie et al. | |
| 3,120,237 | A | | 2/1964 | Lang | |
| 4,889,168 | A | * | 12/1989 | Kerzich et al. | 138/103 |
| 4,967,799 | A | * | 11/1990 | Bradshaw et al. | 138/121 |
| 5,010,852 | A | | 4/1991 | Milisavljevic | |
| 5,035,282 | A | | 7/1991 | Kawashita et al. | |
| 5,277,227 | A | * | 1/1994 | Bradshaw et al. | 138/110 |
| 5,400,830 | A | * | 3/1995 | Stiles et al. | 138/149 |
| 6,000,413 | A | | 12/1999 | Chen | |
| 6,003,305 | A | | 12/1999 | Martin et al. | |
| 6,022,838 | A | | 2/2000 | Martynov et al. | |
| RE37,279 | E | * | 7/2001 | Fisher et al. | 138/156 |
| 6,564,814 | B2 | | 5/2003 | Bowsman et al. | |
| 6,604,512 | B2 | | 8/2003 | Kato | |
| 6,651,604 | B2 | | 11/2003 | Ahmadi et al. | |
| 6,921,020 | B2 | | 7/2005 | Ivri | |
| 6,966,328 | B2 | * | 11/2005 | Benham | 137/599.12 |
| 7,198,066 | B2 | * | 4/2007 | Kagenow | 138/110 |
| 7,406,971 | B2 | | 8/2008 | Velez, Jr. | |
| 2005/0126597 | A1 | | 6/2005 | Hochestein, Jr. et al. | |

* cited by examiner

*Primary Examiner* — Craig Schneider
*Assistant Examiner* — Craig J Price
(74) *Attorney, Agent, or Firm* — Moss & Barnett

(57) ABSTRACT

The present invention provides a delivery system for providing an atomized treatment agent like a cleaner or lubricant to a specific internal location of a closed mechanical system like an internal combustion engine. The atomized treatment agent is delivered via a flexible, non-rigid conduit to the desired internal location of the engine between, e.g., the ID/OD coupling joint between the air inlet hose and the throttle body. A special conduit support guide, the end of which is inserted through the ID/OD coupling joint, provides the proper geometry for gently configuring the conduit to enter the ID/OD coupling joint without crimping and controlling the directional approach and distance of the conduit free end inside the engine.

15 Claims, 7 Drawing Sheets

DIRECTIONAL CONDUIT GUIDE SUPPORT

FIELD OF THE INVENTION

This invention relates to the application of atomized spray products to difficult-to-reach locations. More specifically the invention uses a directional conduit guide support to direct the free end of a non-rigid conduit connected to the atomized spray container to a specific location within an enclosed mechanical system via a non-linear pathway, while preventing crimping of the conduit.

BACKGROUND OF THE INVENTION

An internal combustion engine burns a mixture of fuel and air to produce mechanical energy used to propel, e.g., an automobile. Pistons move up and down inside the engine's cylinders. As the pistons move down, intake valves located above the cylinders open, and fuel and air are sucked into the cylinders. The pistons then move back up inside the cylinders to compress the fuel-air mixture. Electric sparks produced by the vehicle's ignition system spark plugs ignite the fuel-air mixture. The resulting burning gases rapidly expand in volume to force the pistons down again in the engine cylinders to provide the motive power for the vehicle. This power is transferred by the reciprocating piston rods to the crankshaft to the transmission to the vehicle's axle that turns its wheels. The burned gases escape from the piston cylinders via exhaust valves to the vehicle's exhaust system.

A critical component of the engine is the vehicle's air intake system that controls the amount of air flowing into the engine in direct response to the driver's degree of depression of the accelerator pedal. A throttle body is typically located between an air filter box that removes unwanted contaminant particles from the incoming airflow, and the intake manifold of the engine that provides an inlet portal for the air to the piston cylinder intake valves. Positioned within this throttle body is the throttle plate that constitutes a butterfly valve regulating the airflow through the throttle body. As the accelerator is depressed, this throttle plate is rotated within the throttle body to open the throttle passage to permit additional air into the intake manifold An airflow sensor will measure this change in the throttle plate position and communicate with the engine control unit to, in turn, increase the amount of fuel sent to the fuel injectors. In this manner, the fuel and air mixed within the engine's intake manifold are maintained at the desired fuel-air ratio regardless of the accelerator position as the vehicle speeds up or slows down.

Over time, the critical components of the vehicle engine and intake manifold accumulate dirt and residues. For example, the fuel injectors that produce the atomized fuel spray for delivery to the intake manifold tend to accumulate unwanted deposits in the nozzle area resulting in nozzle cloggage. Partial blockage of the fuel spray will produce rough idling of the engine and unwanted hesitation during acceleration. Meanwhile, carbon deposits accumulate in the intake system, itself, caused by the passing fuel. The combusted fuel-air mixture also leaves unwanted carbon deposits in the engine cylinders that can impede the proper piston reciprocation required for smooth engine performance. Furthermore, carbon deposits on piston heads can become hot enough to ignite the fuel-air mixture before the spark plug fires, a condition called "pre-ignition." This condition robs the engine of fuel economy and power, while causing rough engine operation and audible "spark knock" noises.

Various cleaners are available within the industry for cleaning these unwanted deposits and residues from the engine cylinders, piston heads, intake manifold, and fuel injectors. Liquid cleaners can be poured into the vehicle's gasoline tank wherein they mix with the gasoline. Eventually, the cleaning fluid will reach the fuel injectors, intake manifold, piston heads, and engine cylinders via circulation of the gasoline through the vehicle's fuel system. However, the necessity for avoiding corrosion of the rubber hosing between the fuel tank and the fuel injectors requires a relatively dilute cleaner fluid. This reduced concentration of the cleaner fluid significantly compromises its ability to dissolve contaminant deposits in the vehicle engine.

As an alternative, an owner can take his vehicle to a mechanic. The substantial time period required for the dilute cleaners commercially available in the market to work through fuel system circulation make them useless for a mechanic as a diagnostic aid. Alternatively, the mechanic can disassemble the various engine parts to clear them with higher-strength liquid cleaners. However, this process is time-consuming and expensive.

Such cleaning solutions can also be delivered in a spray format to the engine by means of compressed air or an aerosol container. U.S. Pat. No. 3,120,237 issued to Lang discloses a crankcase spray device having a nozzle mounted to a flexible conduit. The nozzle is inserted into the oil discharge outlet of the oil pan for delivery of a cleaning solvent-compressed air admixture for removal of oil sludges inside the oil pan. This device, however, relies upon a discharge port, which is unavailable in other engine parts, and there is no way to orient the pressurized flow of the cleaner inside the oil pan.

U.S. Pat. No. 7,406,971 issued to Velez, Jr. shows a manifold with multiple probes for injecting a cleaner wash into cavities within an aircraft engine turbine blade. The probes appear to be straight without any need to curve them to gain access by the cleaner to an engine part in need of cleaning.

U.S. Pat. No. 6,000,413 issued to Chen teaches a fuel injector cleaning system. A manifold delivers pressurized cleaner via a hose into the fuel injector. However, a special fuel rail connected to the fuel injectors is required, so that the cleaner fluid hose can easily be connected to the engine. Chen does not insert his fluid hose inside the vehicle engine.

U.S. Pat. No. 6,564,814 issued to Bowsman et al. discloses an engine decarbonization system. The cleaner is blown via pressurized air through multiple hoses that need to be connected to the engine after the spark plugs are removed. However, this device requires the removal and reinstallation of the spark plugs, which can be a time-consuming process requiring a mechanic. Special tips and attachments for the cleaner spray head for the particular vehicle engine are also required for proper orientation of the cleaning fluid delivery within the engine.

U.S. Pat. No. 6,651,604 issued to Ahmadi et al. illustrates a cleaner delivery device for an internal combustion engine. The cleaner contained inside an aerosol canister is connected to a "treatment manifold" consisting of a series of rigid hoses or spring-rigid guide tubes which can be oriented without crimping of the tube. But, this device requires an available access port within the engine so that the treatment manifold assembly can be inserted into the engine to gain access to the part that needs to be cleaned. Moreover, Ahmadi requires a skilled technician to use this device, probably due to the specialized knowledge and training required for working with the engine access port and proper orientation of the treatment manifold hoses.

Proper cleaning of engine parts does require specific directional delivery of the cleaning compound to difficult-to-reach regions within the engine. Most vehicle engines feature an air intake hose connected to the throttle body that can be utilized for introduction of the atomized cleaning compound into the engine. But, such air intake hose is typically connected to the throttle body inlet collar via an inside diameter ("ID")/outside diameter ("OD") coupling joint that enables a clamp to tightly fasten the hose around the collar. This orientation of the ID/OD coupling joint makes it impossible to insert a straight conduit extending from the aerosol canister through the gap in the ID/OD coupling joint for proper alignment with the internal air flow direction without bending the conduit. Yet, this curved, non-linear pathway for delivery of the cleaning compound from the canister to the internal engine location can lead to crimping of the conduit that blocks the flow of the atomized cleaner through the conduit, or else fails to maintain proper orientation of the leading end of the conduit inside the throttle body toward the throttle plate. Crimping of the conduit can occur at the point at which it passes between the downstream end of the air intake hose and the throttle body, because of the tight fit of the ID/OD coupling joint. It would therefore be beneficial to provide a delivery system for providing the cleaner in atomized format via a non-rigid conduit to an internal engine location in accordance with the required directional orientation without crimping of the conduit, and without the need for complicated disassembly of the engine to gain access by the cleaning compound to the desired internal engine location.

SUMMARY OF THE INVENTION

The present invention provides a delivery system for providing an atomized treatment agent to a specific internal location of a closed mechanical system like an internal combustion engine. Such system comprises a container for holding the atomized treatment agent under pressure as an aerosol or under compressed air, so that the atomized treatment agent is ejected in atomized form. The atomized treatment agent is delivered via a flexible, non-rigid conduit to the desired internal location inside the closed mechanical system. The free end of the conduit is inserted a predetermined distance into the closed mechanical system between, e.g., the ID/OD coupling joint between an air inlet hose and the cooperating inlet port collar of the part of the closed mechanical system whose interior needs to be treated. The vacuum condition prevailing within the closed mechanical system will draw the atomized treatment agent into proximity with the internal surface or part of the closed mechanical system, such as the fuel injectors, intake manifold, engine cylinders, or other desired parts of a vehicle engine to contact and chemically treat unwanted residues and/or provide lubrication. The flexible, non-rigid conduit of the delivery system is threaded through a special conduit support guide, the end of which is inserted through the ID/OD coupling joint connecting, e.g., the throttle body and the air intake hose of the engine. This guide bears the proper geometry for gently configuring the conduit to accommodate the spatial relationship between the atomized treatment agent canister and throttle body without crimping the conduit where it passes between the throttle body and the air intake hose, controlling the directional approach of the conduit free end inside the engine, and allowing the conduit to be inserted into the throttle body to a measured distance without the need to cut the free end of the conduit to length. In this manner, the system provides a simple, efficient, reliable, and cost-effective means for delivering, e.g., a cleaning compound or lubricant to the desired engine internal location without the need to take the engine apart or equip it with a special inlet delivery system.

DETAILED DESCRIPTION OF THE PREFERRED EMBODIMENT

Figure 1:
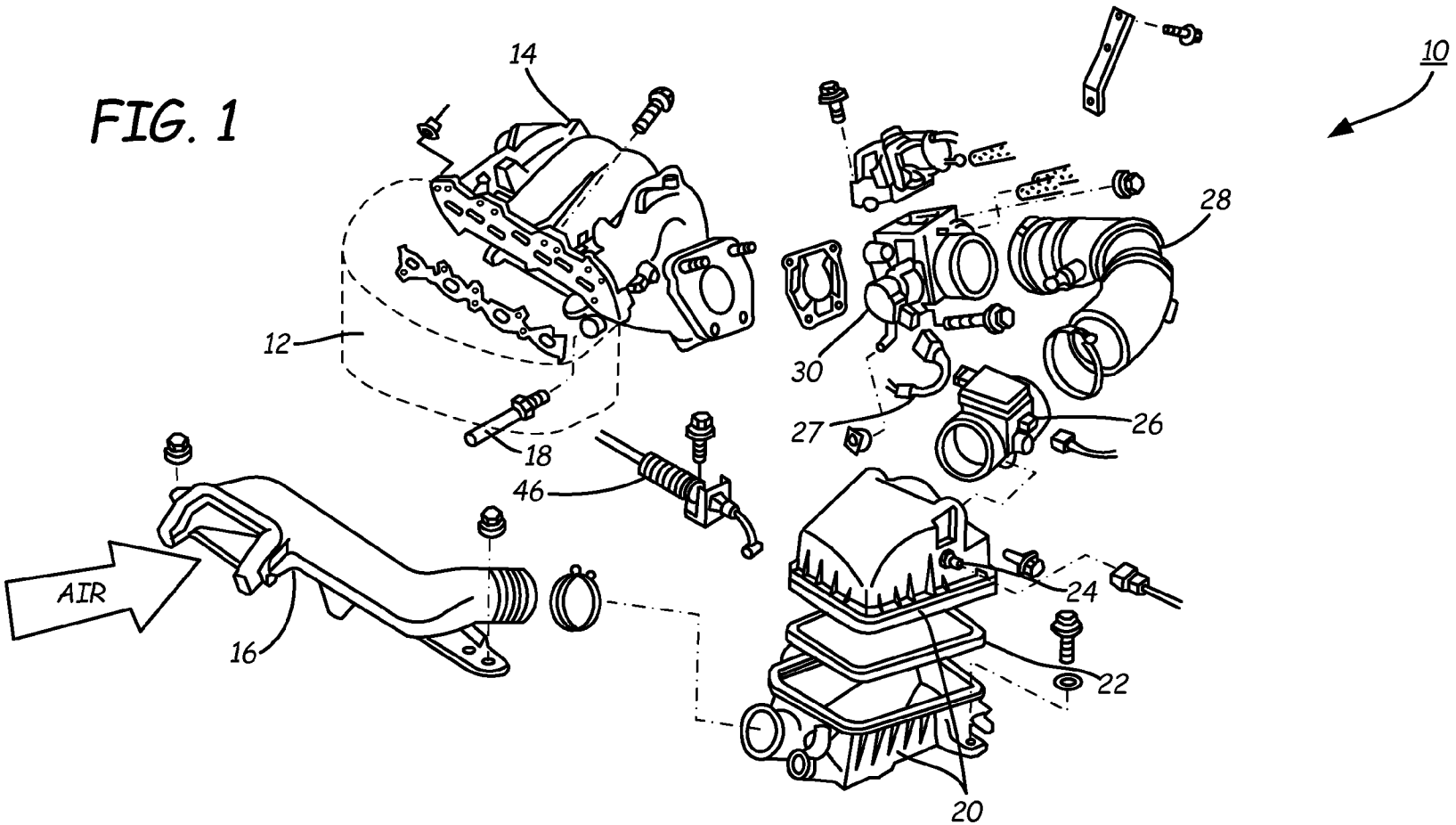
FIG. 1 is an exploded perspective view of the air intake and throttle body system for an internal combustion engine.

A delivery system for providing an atomized treatment agent to a specific internal location of a closed mechanical system like an internal combustion engine is provided by the invention. Such invention comprises a container for holding the atomized treatment agent under pressure as an aerosol or under compressed air, so that the atomized treatment agent is ejected in atomized form. The atomized treatment agent is delivered via a flexible, non-rigid conduit to the desired internal location inside the closed mechanical system. The free end of the conduit is inserted a predetermined distance into the closed mechanical system between, e.g., the ID/OD coupling joint between an air inlet hose and the cooperating inlet port collar of the mechanical part whose interior needs to be treated. The vacuum condition prevailing within the mechanical system will draw the atomized treatment agent into the internal mechanical system part, such as the fuel injectors, intake manifold, engine cylinders, or other desired parts of a vehicle engine to contact and chemically treat unwanted residues and/or provide lubrication. The flexible, non-rigid conduit of the delivery system is threaded through a special conduit support guide, the end of which is inserted through the ID/OD coupling joint connecting, e.g., the throttle body and the air intake hose of the engine. This guide bears the proper geometry for gently configuring the conduit to accommodate the spacial relationship between the atomized treatment agent canister and throttle body without crimping the conduit where it passes between the throttle body and the air intake hose, controlling the directional approach of the conduit free end inside the engine, and allowing the conduit to be inserted into the throttle body to a measured distance without the need to cut the free end of the conduit to length. In this manner, the invention provides an efficient, reliable, and cost-effective delivery system for the cleaning compound with respect to the desired engine internal location.

For purposes of the present application, "closed mechanical system" means any enclosed piece of machinery or equipment containing working parts whose optimal operation requires periodic treatment of those parts or internal working surfaces. Examples of such closed mechanical systems include without limitation, internal combustion engines, machinery and equipment used in manufacturing or assembly plants or other shops or facilities that are operatively connected to compressed air, forced air heat, ventilation, or air conditioning system ducts, and vacuum systems.

For purposes of the present invention, "atomized treatment agent" means any compound in aerosol or compressed air delivery format used to treat the internal surface of a closed mechanical system or working parts contained therein. Examples, without limitation, include cleaning compounds, anti-mold or fungal agents, fresheners, scents, lubricants, and alcohol agents used to reduce moisture or condensation.

In the present application, "cleaning compound" means any petroleum or chemical solvent-based substance useful for dissolving and cleaning undesirable deposits from internal locations or off working parts contained within a closed mechanical system.

In the context of the present invention, "deposits" means any residues, accumulations, and other deposits left on an internal surface or working part of a closed mechanical system, such as harmful gums, varnish, and carbon compounds left by combusted or un-combusted gasoline, diesel, methanol, ethanol, or other fuels within an internal combustion engine, molds, fungus, dirt, grime, moisture, or condensation.

For purposes of this application, "internal location" for deposits within an internal combustion engine includes, without limitation, fuel injectors, throttle plates, intake manifolds, intake valves, combustion cylinders, and pistons heads found within the engine.

Although the present invention may be used in a variety of end-use applications for delivering atomized treatment agents to the interior of any closed mechanical system accessible through an ID/OD coupling joint, for illustrative purposes only, the invention is described herein with respect to the cleaning of harmful gums, varnish, and carbon deposits from fuel injectors, air induction systems, piston heads, intake valves, and combustion chambers in gasoline engines for motor vehicles. This is not meant to limit in any way the application of the apparatus and method of this invention to other appropriate or desirable end-use applications outside these automotive engine cleaning applications.

FIG. 1 shows the air intake system and throttle body portions 10 of an internal combustion engine 12. Intake manifold 14 is mounted to the engine block 12 for purposes of delivering the atomized fuel-air mixture to the piston cylinders (not shown) during the engine's intake cycle. Note that the engine can have any number of piston cylinders (e.g., 4, 5, 6, 8, 10, or 12) for purposes of this invention. This intake manifold constitutes an interior chamber for receiving ambient air that enters the system via inlet air duct 16, and fuel (e.g., gasoline, diesel, methanol, or ethanol) that enters the intake manifold via fuel line 18. This air-fuel mixture is drawn into the piston cylinders during the engine's intake cycle via induction when the inlet valves (not shown) of the piston cylinders open.

The air passing through inlet air duct 16 travels through air cleaner 20 to remove particulate material via filter pad 22 that might otherwise damage or impede the proper operation of engine 12. The temperature of this air-stream is also measured by intake air temperature sensor 24 disposed inside the air filter chamber. Upon exiting air cleaner 20, this filtered airflow then moves through the air intake hose 28, which is commonly called a "boot" within the automotive industry. Attached to the air intake hose 28, or a nearby component of the air passage located downstream of the air cleaner 20, is a mass airflow sensor 26, which is suspended in the air stream moving through the intake hose 28. It measures the air's mass and flow rate. mass airflow sensor 26 which measures the mass and flow rate of this moving air-stream. The downstream outlet of this air intake hose 28 is connected to the inlet of throttle body 30.

Figure 2:
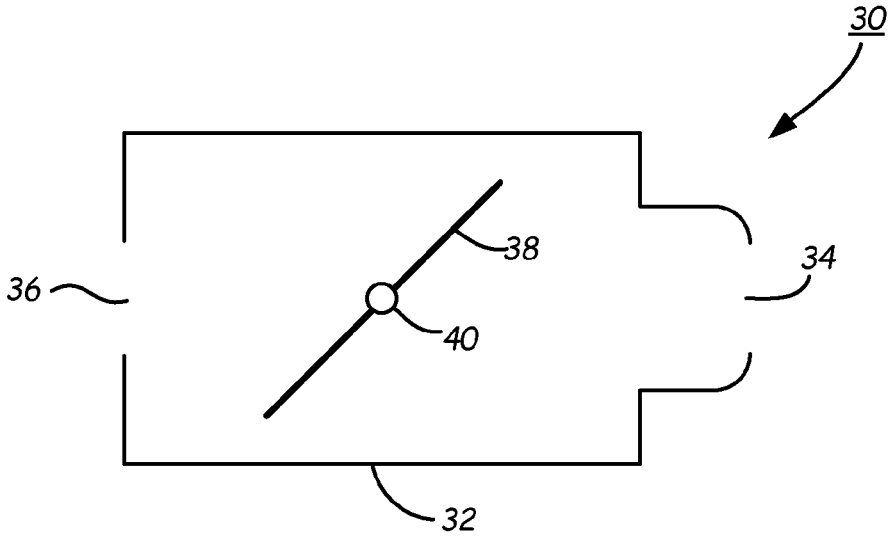
FIG. 2 is a schematic view of the throttle body.

Shown schematically in FIG. 2, throttle body 30 comprises a housing 32 having an inlet 34 which is attached by means of a clamp (not shown) to the air intake hose 28. The outlet 36 of throttle body allows air to pass into intake manifold 14 when the throttle body is secured thereto. Disposed inside throttle body 30 is butterfly valve 38 which pivots along point 40 so that butterfly valve can be rotated along this axis to open or close the through passage for airflow through the throttle body. Accelerator cable 46 attached at its one end to the vehicle's accelerator is operatively connected at its other end to the throttle body, so that the butterfly valve 38 pivots to a more open position in response to depression of the accelerator in order to admit additional air through the throttle body into intake manifold 14. When the throttle plate is wide open, the intake manifold is usually at ambient atmospheric pressure. When the throttle is partially closed, a manifold vacuum develops as the intake drops below ambient pressure. This partial vacuum condition helps to draw the air-fuel into the piston chambers of the engine block 12 when the inlet valves open. Note that vehicles within the automotive industry are increasingly using electronic throttle bodies for increased fuel efficiency that dispose with the mechanical cable. However, for such electronic throttle bodies, the principle is still the same: the butterfly valve inside the throttle body moves in response to the accelerator pedal position.

Turning to FIG. 1, the mass airflow sensor 26 communicates the change in air flow in response to the driver's depression of the accelerator 46 to an engine control unit contained inside the engine's central computer. As a result, the engine control unit will adjust the amount of fuel sent to the intake manifold 14 via fuel line 18 to maintain the preset air-fuel ratio.

Over time, carbon deposits, harmful gums, varnish and other residues will build up within the intake manifold, fuel injectors, and combustion chambers due to the fuel passing through the engine system and the combustion of the fuel within the engine cylinders. These accumulated deposits will cause the engine to hesitate, stall, ping, or idle roughly during the engine cycle by interfering with proper fuel flow through the engine parts and proper reciprocating movement of the pistons inside their cylinders. These accumulated deposits may also reduce fuel mileage of the vehicle due to reduced engine efficiency.

In order to remove these accumulated deposits from the internal engine surfaces, one needs to use a cleaner agent that is capable of dissolving the deposits so that they can pass along with the fuel to the engine combustion cylinders and ultimately out of the vehicle via its exhaust system. Such a cleaner ideally should be petroleum-based so that it is compatible with the fuel for the vehicle, although many chemical solvent-based cleaner agents are also available in the market. This cleaner should also contain one or more active cleansing agents from the naptha family, of chemicals for petroleum-based cleaners, and acetone, ketone, MEK, xylene, toluene, and methanol for chemical-based cleaners that are capable of dissolving carbon, varnish, gum and other organic compound deposits. The cleaner should preferably contain a lubricating agent from the pale oil (?) or other petroleum-derived compounds that will lubricate the throttle plate, bushings, and intake valves, cylinders, rings, and other moving engine parts, as the cleaner passes through the engine system. Finally, the cleaner compound needs to be safe for use in conjunction with the various sensors, plastic, rubber, and other delicate parts of the engine.

Several examples of this cleaner compound are available in the market. On such product comprises Sea Foam Spray™ manufactured and sold by Sea Foam Sales Co. Another product available from Sea Foam Sales is Deep Creep™ cleaner. While the engine cleaning system of the present invention is ideally suited to Sea Foam Spray and Deep Creep Spray, it is not limited to these particular products. Other petroleum-based cleaners like an upper cylinder lubricant and fuel injector cleaner sold by Lucas Oil Products, Inc. of Corona, Calif., or Chevron Techron fuel system cleaner sold by Chevron Products will suffice. Examples of chemical solvent-based cleaner compounds include B-12 Chemtool gas treatment carburator cleaner sold by Berryman Products of Arlington, Tex., or STP fuel system cleaner sold by Chlorox Company of Oakland, Calif.

Figure 3:
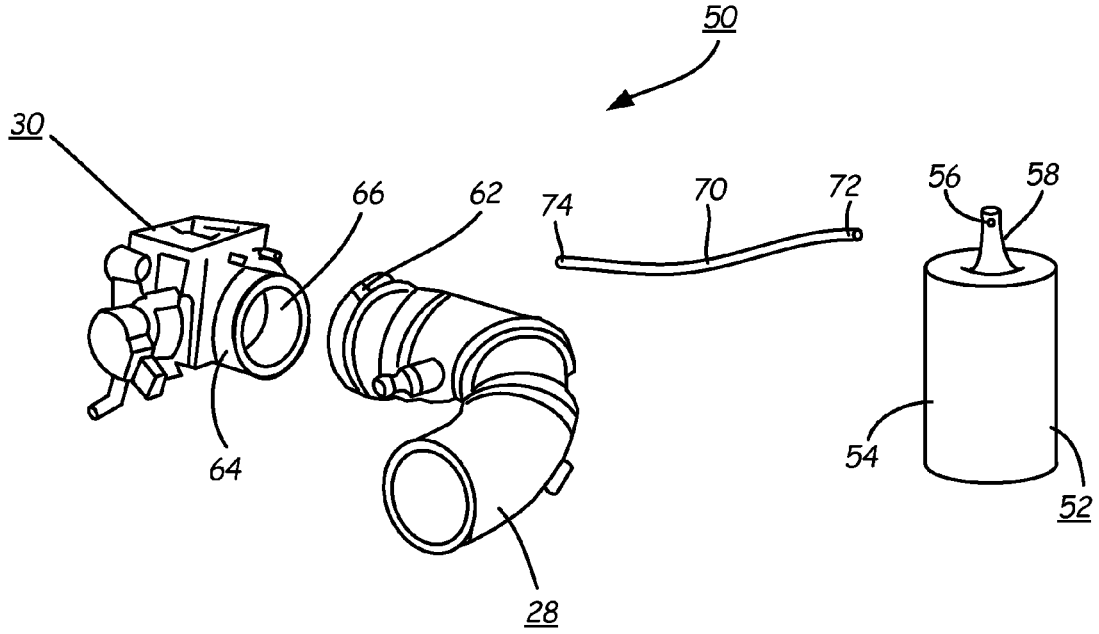
FIG. 3 is an exploded perspective view of the throttle body, air intake hose, and cleaner delivery system of the present invention.

FIG. 3 illustrates the engine cleaning delivery system 50 of the present invention. The cleaner agent 52 is preferably contained within a container 54 under pressure, and discharged through outlet hole 56 of nozzle actuator 58 when it is depressed by the user's finger. A fine misting spray of the cleaner will emanate from nozzle hole 56 that it can be directed onto the surface of an engine part containing accumulated residue. In that case, the cleaner and dissolved residues may be wiped from the engine part surface after the cleaner has come into contact with the residue deposit for a sufficient time period to dissolve the deposit.

However, many engine parts in need of cleaning are inaccessible to the direct spray of the cleaner, and it is expensively impractical to disassemble the engine to gain access of the part in need of cleaning. But, throttle body 30 contains the throttle plate which, when opened or partially opened, will readily admit air to pass into the intake manifold 14 in which the air is mixed with the fuel. By introducing the cleaner into the throttle body, it can become entrained in the air flow stream for mixing with the fuel inside the intake manifold. In this manner, the cleaner can be carried by the air-fuel mixture via induction into the intake valves and engine cylinders downstream in the engine system.

Figure 4:
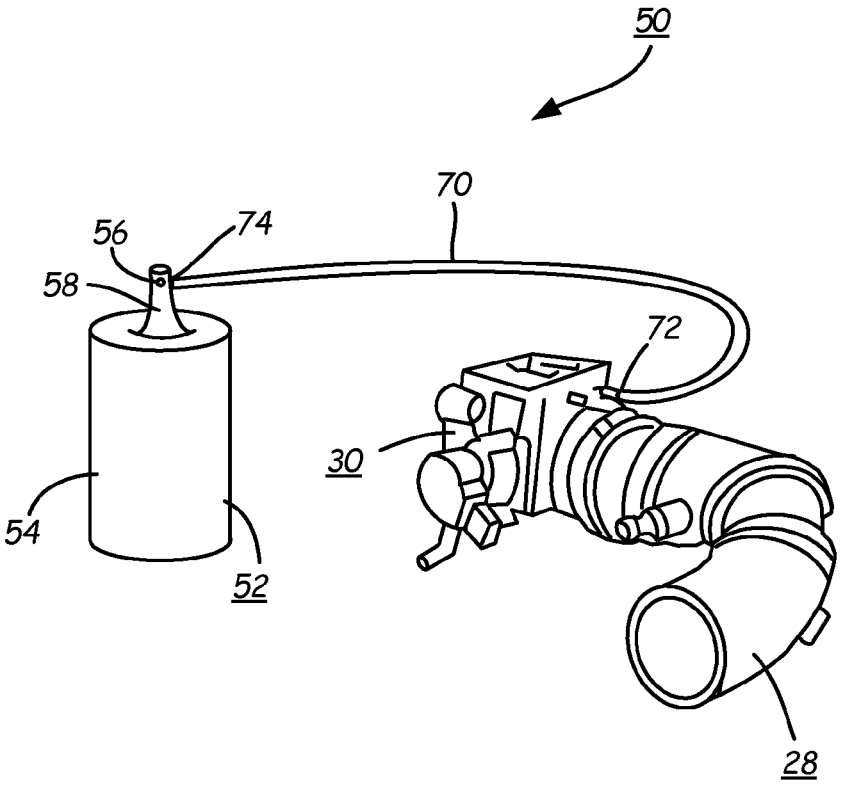
FIG. 4 is a perspective view of the cleaner delivery system inserted between the ID/OD coupling joint between the air intake hose and the throttle body.
Figure 5A:
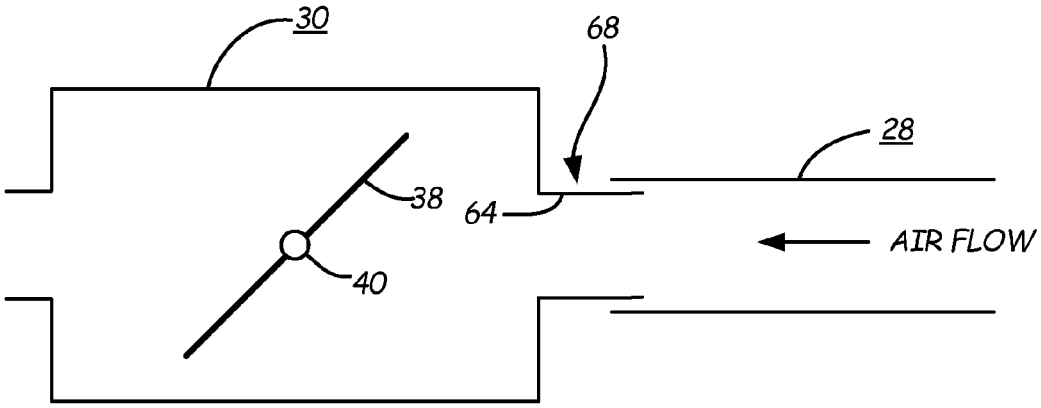
FIG. 5 is a cut-away view of the conduit of the cleaner delivery system inserted through the ID/OD coupling joint between the six intake hose and throttle body.
Figure 5B:
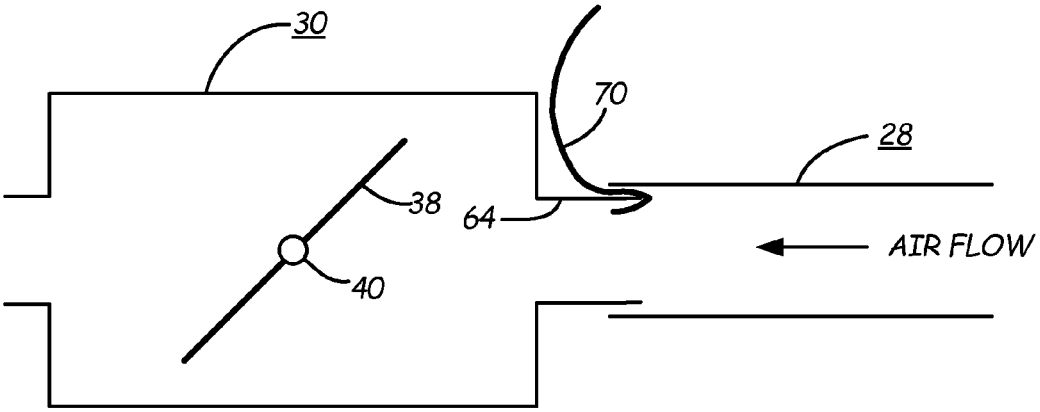

Removal of downstream end 62 of air intake hose (boot) 28 from inlet collar 64 of throttle body 30 provides ready access to the throttle plate 38 of the throttle body. The cleaner agent 52 could be sprayed directly through intake port 66 of throttle body 30 as the engine is revved to open the throttle plate. However, most engines have mass airflow sensors that prevent the engine from running while the air intake hose 28 is disconnected from the throttle body inlet collar 64. Therefore, conduit 70 can be connected at its upstream end 72 to discharge hole 56 of nozzle 58 of cleaner can 54 with the cleaner discharged from outlet end 74 of conduit 70 as a fine spray. But this conduit must still be inserted into the throttle body inlet collar while the air intake hose is connected to the collar so that the engine can be reserved to draw the sprayed cleaner into the throttle body via induction to the intake manifold. Reassembly of downstream end 62 of air intake hose 28 over inlet port collar 64 of throttle body 30 with conduit 70 inserted inside the inlet collar, as shown in FIG. 4, will provide the necessary closed environment required for engine function. However, several potential problems arise from this use of the air intake hose 28 to create a closed environment around the throttle body inlet collar 64. FIG. 5*a* demonstrates the geometric challenge posed by the ID/OD coupling joint 68. The air intake hose 28 typically fits with its inside diameter surface over the outside diameter surface of inlet collar 64 of throttle body 30. This permits a clamp (not shown) to tightly secure the end of the air intake hose to the throttle body inlet collar to create the necessary sealed environment. However, the cleaner agent must be discharged through conduit 70 in the same direction as the direction of the airflow passing through the air intake hose and the throttle body. If the air intake hose fit inside the throttle body collar instead with its exterior touching the interior of the throttle body collar, than the conduit 70 used to discharge the cleaner agent inside the throttle body could be straight. But, because the interior of the air intake hose needs to fit around the exterior of the throttle body collar, the conduit must be curved as shown in FIG. 5*b*, so that the conduit can fit through the ID/OD coupling joint 68 with its distal end 74 reoriented in proper alignment with the air flow.

Smaller diameter conduits will need to be used in order to accommodate the tight-fitting clearance between air intake hose 28 and throttle body inlet collar 64. For purposes of this engine cleaner delivery system 50, the outside diameter of conduit 70 to should accommodate the spray nozzle. Such conduits may typically have an exterior diameter range of about 0.08-0.09 inches. Moreover, such conduit 70 will necessarily require thin side walls of about 0.04-0.05 inches, preferably 0.045 inches, so that it can exhibit some degree of flexibility to enable non-linear, arced configurations.

Such conduit 70 can be manufactured from flexible plastics like polypropylene or polystyrene that will not deteriorate under the impact of the petroleum or solvent-based compounds contained within cleaner spray 52. Thus, the material used for the conduit should be chosen with regard to the reactions with the intended cleaning solution.

However, thin-walled conduits often suffer from crimping when bent into a curved arc. Air intake hose 28 over throttle body inlet collar 64 will cause further crimping of thin-walled conduit 70.

Figure 6:
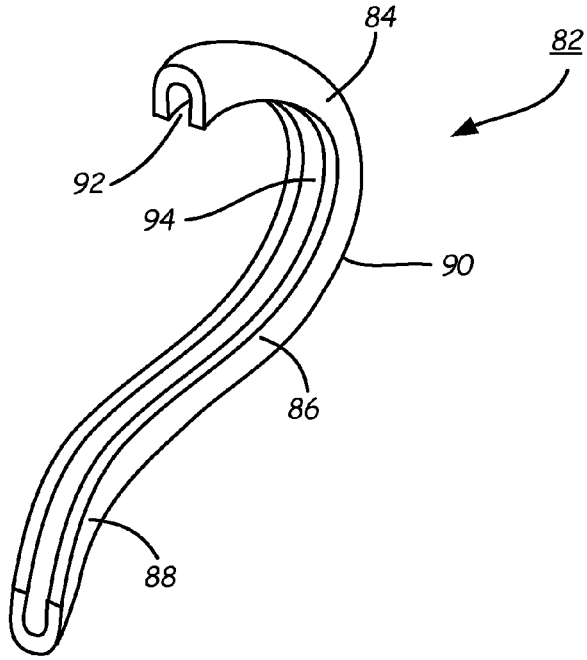
FIGS. 6-8 are different perspective views of the conduit guide of the present invention of maintaining proper, protected orientation of the conduit for the cleaner delivery system.
Figure 7:
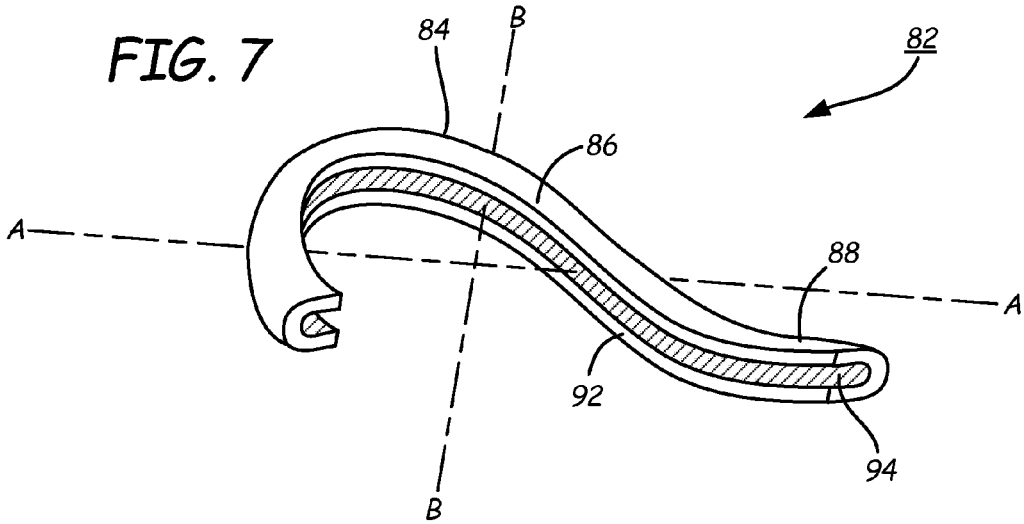
Figure 8:
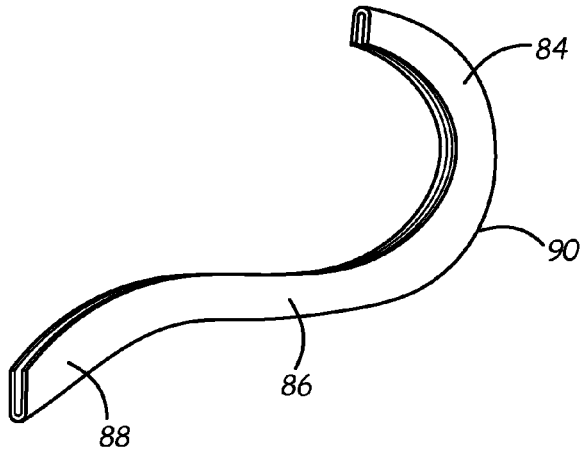

An important feature of the engine cleaner system 50 of the present invention is a specially configured conduit guide support 82 for use in association with conduit 70. As shown more fully in FIGS. 6-8, this conduit guide support 82 has a longitudinal axis A-A and a transverse axis B-B perpendicular to the longitudinal axis. The conduit guide support 82 is shaped like a question mark with a curved body 84, a transitional body 86, and a hooked body 88. This curved body 84 constitutes a first body portion bearing a configuration that is curved outwardly from the longitudinal axis A-A. The transitional body 86 and hooked body 88 of the conduit guide support 82 constitutes a second body portion having a distal end, the second body portion being integrally connected to the outwardly curved first body portion, and having a configuration that curves back towards the longitudinal axis A-A, so that the second body portion forms a hook. The outer side 90 should be smooth without any sharp surfaces that can catch on the air flow hose 28 or other engine parts. Positioned along inner side 92 of conduit guide support 82 is open channel 94 which runs along its entire length. This channel 94 partially extends into the first and second body portions along transverse axis B-B, and has a width and depth sized to accommodate the outside diameter of conduit 70, and partially surround the outside surface of the conduit. Preferably, the sizes of channel 94 and the outside diameter of conduit 70 should enable a length portion of the conduit to be snap fitted into the channel of the conduit guide support.

Figure 9:
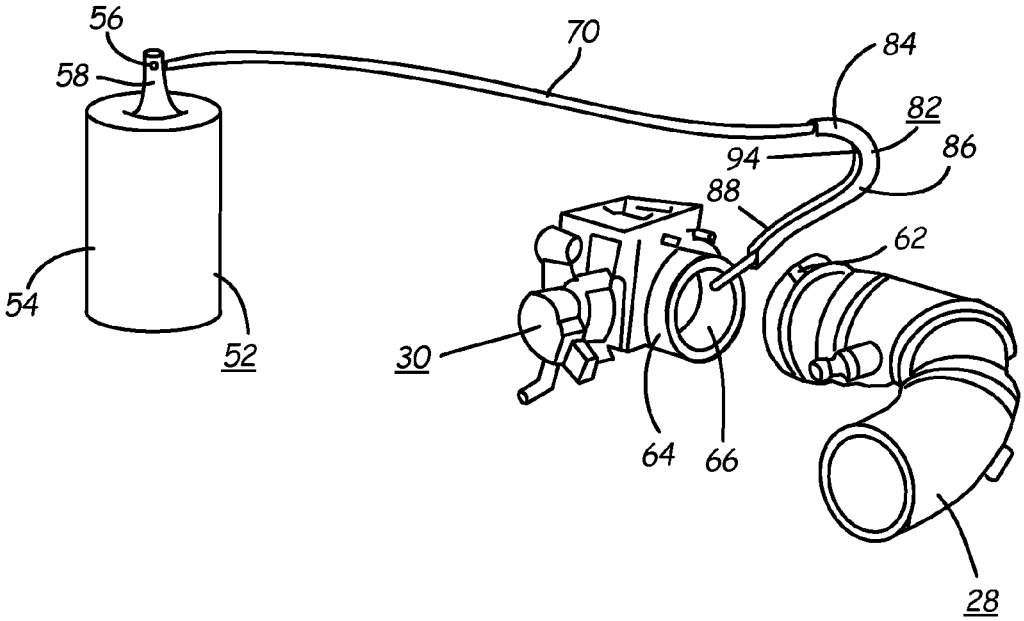
FIG. 9 is an exploded perspective view of the conduit inserted into the throttle body through the ID/OD coupling joint with the assistance of the conduit guide.

FIG. 9 shows the engine cleaner system 50 of the present invention with the conduit guide support 82. The throttle body 30 and air intake hose 28 are separated in an exploded view for clarity of depiction, although the downstream end of air intake hose 28 will be closely fitted around inlet collar 64 of throttle body as shown in FIG. 4 in actual end use. The second body portion of conduit guide support 82 is inserted into inlet port 66 of throttle body 30 between the throttle body collar and air intake hose end. This second body portion protects the conduit, when it is placed inside open channel 94, from crimping by the air intake hose pressing against the throttle body collar. The hooked body 88 of the second body portion of the conduit guide also directs the free end of conduit 70 inside the throttle body in the direction of the throttle plate. Thus, it ensures proper orientation of the cleaner spray with respect to the opened throttle plate and direction of air flow entering the engine.

Transition body 86 and curved body 84 of the conduit guide support produce a gentle curvature of the conduit 70 without crimping. Channel 94 protects the conduit along its entire length portion that is in the conduit guide support 82.

In order to clean the vehicle engine, the mechanic or other user should locate the throttle body 30 and remove the air intake hose 28. The conduit 70 should be snap fitted into channel 94 of conduit guide support 82, so that the guide support encapsulates the exterior surface of the flexible conduit, and a pre-measured length of conduit extends beyond the hooked body end 84. This conduit should be installed inside the throttle body 30 inlet and directly in front of the throttle plate. Ideally, this placement should be at the top center of the throttle body housing (12 o'clock) and within ¼ inch in front of the throttle plate. The hooked body 84 of the conduit guide support 82 should extend into the narrow space between the throttle body collar 64 and the downstream end of the air intake hose 28. The conduit 70 can be moved along the length of the conduit guide support channel 94 to produce this ¼ inch gap between the free end of the conduit and the throttle plate. The air intake hose 28 is then reinstalled over the throttle body collar 64 to hold the conduit 70 encapsulated therein in place.

With the vehicle in park or neutral and parking brake engaged, the engine should then be started and increased until it idles at a speed of about 500-1000 rpm above the factory idle specification for the vehicle. This increased engine rpm speed is important for purposes of fully atomizing the cleaner, distributing it evenly inside the airflow incoming from the air intake hose 28, and causing the cleaner spray 52 to pass through the throttle body, instead of the air by-pass.

The engine rpm speed should be held steady for approximately five minutes. Connecting the other end 72 of the conduit 70 to container spray nozzle 58, the nozzle should be depressed to discharge the desired amount of the cleaner product through the conduit 70 into throttle body 30 and by induction into intake manifold 14 and the engine piston chambers. This should typically take approximately 2-3 minutes. Upon stopping the spray, the engine is returned to its normal idle speed and it is then turned off. The conduit 70 and guide support 82 is then removed from the throttle body 30 and the air intake hose 28 reattached to the throttle body inlet collar 64 and secured in place with a clamp (not shown). After letting the vehicle sit for about five minutes, the engine is then restarted in a well-ventilated area. The exhaust will contain the carbon, varnish, gums, and other residue dissolved by the cleaner during the cleaning cycle.

The above specification and drawings provide a complete description of the structure and operation of the engine cleaning system of the present invention. However, the invention is capable of use in various other combinations, modifications, embodiments and environments without departing from the spirit and scope of the invention. Therefore, the description is not intended to limit the invention to the particular form disclosed.

We claim:

1. A delivery system for discharging an atomized treatment agent into an interior of a closed mechanical system having a fluidizing gas inlet collar joined to an overlaid gas supply hose via an ID/OD coupling, joint for receiving passage of a gas through the gas supply hose into the closed mechanical system in a longitudinal direction, such system comprising:

(a) a pressurized container holding the atomized treatment agent for treating an interior surface or working part contained inside the closed mechanical system;

(b) a flexible conduit for delivering the atomized treatment agent from the container to the closed mechanical system;

(c) a guide support for the flexible conduit having a longitudinal axis and a transverse axis perpendicular to the longitudinal axis, the guide support comprising:

(i) a first body portion with a configuration curved outwardly from the longitudinal axis;

(ii) a second body portion having a distal end, the second body portion integrally connected to the outwardly curved first body portion with a configuration that curves back towards the longitudinal axis so that the second body portion forms a hook;

(iii) an open channel formed into an entire length of an inner side surface of the guide support partially extending into the first and second body portions along the transverse axis, said channel having dimensions configured to partially surround an exterior surface of the flexible conduit;

(iv) with the flexible conduit disposed inside the open channel, the second body portion of the guide support being positioned between the closed mechanical system fluidizing gas inlet collar and the air supply hose with the second body portion with the hook causing the flexible conduit to extend inside the closed mechanical system with the distal end pointed in a same direction as a fluidizing gas flow;

(d) wherein the atomized treatment agent is delivered by the flexible conduit from the pressurized container to an interior location of the closed mechanical system; and (e) wherein the flexible conduit is disposed inside the channel of the rigid guide support, so that the guide support protects the flexible conduit from crimping.

2. The delivery system of claim 1, wherein the closed mechanical system is an article of machinery or equipment.

3. The delivery system of claim 1, wherein the closed mechanical system is a forced air heating, ventilation, or air conditioning duct.

4. The delivery system of claim 1, wherein the atomized treatment agent is a cleaner.

5. The delivery system of claim 1, wherein the atomized treatment agent is a lubricant.

6. The delivery system of claim 1, wherein the atomized treatment agent is an anti-mold or fungus agent.

7. The delivery system of claim 1, wherein the atomized treatment agent is a condensation or moisture treatment agent.

8. The delivery system of claim 1, wherein the atomized treatment agent is an air freshener or scent.

9. The delivery system of claim 1, wherein the atomized treatment agent is delivered through the flexible conduit as an aerosol.

10. The delivery system of claim 1, wherein the atomized treatment agent is delivered through the flexible conduit by means of compressed gas.

11. The delivery system of claim 1, wherein the fluidizing gas is air.

12. The delivery system of claim 1, wherein the fluidizing gas is an industrial gas.

13. The delivery system of claim 1, wherein the closed mechanical system is an internal combustion engine.

14. The delivery system of claim 13, wherein a cleaner is discharged into a throttle body of the internal combustion engine to dissolve unwanted residue deposits on an internal surface or working part within the engine.

15. The delivery system of claim 13, wherein a lubricant is discharged into a throttle body of the internal combustion engine to lubricate a working part within the engine.

* * * * *